United States Patent [19]

Skrzycki

[11] Patent Number: 4,853,966

[45] Date of Patent: Aug. 1, 1989

[54] SPEAKER MOUNTING SYSTEM

[76] Inventor: Gary E. Skrzycki, 770 Orion Rd. #434, Lake Orion, Mich. 48035

[21] Appl. No.: 114,047

[22] Filed: Oct. 29, 1987

[51] Int. Cl.[4] ..... H04R 1/02

[52] U.S. Cl. ..... 381/188; 181/150

[58] Field of Search ..... 181/141, 148, 149, 150, 181/155, 171, 172; 381/86, 87, 88, 188, 189, 205

[56] References Cited

U.S. PATENT DOCUMENTS

| | | | |
|---|---|---|---|
| D. 255,234 | 6/1980 | Wellward et al. | 181/150 X |
| 2,150,210 | 3/1939 | Dreyfus | 181/148 X |
| 2,567,829 | 9/1951 | Suthann | 381/205 X |
| 2,753,009 | 7/1956 | Shaffer | 181/150 |
| 3,391,754 | 7/1968 | Montanaro | 181/149 |
| 3,987,258 | 10/1976 | Tsutsui et al. | 181/155 X |
| 4,056,165 | 11/1977 | Okamoto et al. | 181/150 X |
| 4,090,582 | 5/1978 | Deschu | 181/150 |
| 4,143,249 | 3/1979 | Cinquino | 381/86 X |
| 4,550,796 | 11/1985 | Tomita | 181/171 X |

*Primary Examiner*—L. T. Hix

*Assistant Examiner*—Brian W. Brown

*Attorney, Agent, or Firm*—Arnold S. Weintraub; Gerald R. Black

[57] ABSTRACT

An audio speaker mounting plate is disclosed that can be easily adapted for cars, boats, planes, or the like. This mounting system is inexpensive to manufacture, lightweight, and easy to install and repair. The mounting bracket is, preferably circular and has an inwardly extending collar which engages the speaker inserted therein. An audio system mounting assembly, includes a mounting bracket having a main body section with a hollow center portion, a mounting flange to be secured to the outer surface of a wall panel, and a mounting collar. An audio speaker is secured directly to the mounting collar of the bracket. A speaker cover fits within the hollow center portion of the mounting bracket. The system may also include a backing plate to insure a secure engagement of the panel mounting fasteners, which extend through the outer flange of the mounting bracket.

13 Claims, 1 Drawing Sheet

SPEAKER MOUNTING SYSTEMF

BACKGROUND OF THE INVENTION

1. Technical Field

The present invention relates to improvements regarding an audio speaker mounting system, and more particularly, to a novel assembly for mounting portable speakers in vehicles, and the like.

2. Background Art

In the standard am radios that have been used in most cars, high quality speaker systems were not needed because of generally poor reception. These radios did not have elaborate speaker systems, but rather only one speaker was needed, which was generally incorporated into the radio. With the advance of vehicular fm-stereo sound systems, more sophisticated speaker systems are necessary to fully enjoy the improved sound quality. Traditionally, elaborate speaker mounting systems have been mechanically complex, making them difficult to adapt for mounting in the interior of a vehicle.

For example, Shaffer in U.S. Pat. No. 2,753,009 discloses a speaker mounting unit which has a flange adapted to extend inwardly from the outer most periphery of an aperture in a wall. There is a base member which is adapted to be fastened into a horizontal wall member and extends into the aperture defined by the finishing surface of the wall. The outer lip of the speaker cone is bolted to the inner end of the flange, permitting the speaker cone to rest against the edge of the base member.

Dreyfus in U.S. Pat. No. 2,150,210 discloses a radio receiver which has an outer frame secured in the surface of a cabinet. The outer frame has an outwardly extending lip which extends over the cabinet surface. The flange helps to secure the perforated cover disk to the speaker cone. The speaker cone is secured directly to the interior surface of the cabinet.

Montanaro in U.S. Pat. No. 3,391,754 discloses a waterproof radio, which includes a speaker mounting unit. A conventional speaker is attached to the radio casing by an annular mounting flange, and is affixed to the speaker in assembly with a cone diaphragm and a spacing member by an adhesive.

Suthann in U.S. Pat. No. 2,567,829 discloses a complex, combined cabinet and chassis for mounting a speaker assembly and other electrical components. A conventional grill overlays the speaker cone. Tsutsui et al. in U.S. Pat. No. 3,987,258 discloses a water-proof sound system which includes a speaker mounting device. The speaker is mounted against the surface of the cabinet.

Most recently, there have been major breakthroughs in sound reproduction equipment, including cassette tapes, laser disks, and digital sound. Cassette tape players are standard equipment in most high performance sports cars, and are offered as options in most other cars. Also, compact disk players have captured a significant portion of the audio market, and are standard equipment in most spots cars that are made in Japan.

With the improved quality of the original recording and with the elimination of transmission and reception problems, audio equipment for vehicles must be portable and rugged.

SUMMARY OF THE INVENTION

The present invention provides a simplified speaker mounting system, that is inexpensive to manufacture, light-in-weight, and easy to install.

The present invention also provides a hermetically sealed speaker mounting system for use in homes, cabinetry, cars, trucks, boats and planes. This speaker mounting bracket is particularly easy to adapt to fit the door panel, read deck lid, or the like of any vehicle. The bracket may also be used in cabinets or building walls.

The audio system mounting assembly, includes a mounting bracket having a main body section with a hollow center portion, a mounting flange to be secured to the outer surface of a wall panel, the flange extending outwardly in an essentially orthogonal direction from the body section, and a mounting collar extending inwardly and substantially parallel to the flange. An audio speaker is secured directly to the mounting collar of the bracket. A speaker cover fits within the hollow center portion of the mounting bracket. The system may also include a backing plate which may be used for securely engaging the panel mounting fasteners, which extend through the outer flange of the mounting bracket.

The speaker mounting bracket of the present invention although having any desired configuration is, preferably, circular. Preferably, an engaging means is used to engage the speaker cover directly to the bracket. This engagement may be accomplished by designing a slight inward taper in the main body section which couples with the grill which is insertable therein.

The novel features which are believed to be characteristic of this speaker mounting system will be better understood from the following description in connection with the accompanying drawings in which the presently preferred embodiment is shown by way of example. It is expressly understood, however, that the drawings are for purposes of illustration only, and are not intended as a limiting of the scope of the invention. Throughout the following description and drawings, identical reference numbers refer to the same component throughout the several views.

DETAILED DESCRIPTION OF THE PREFERRED EMBODIMENT

Figure 1:
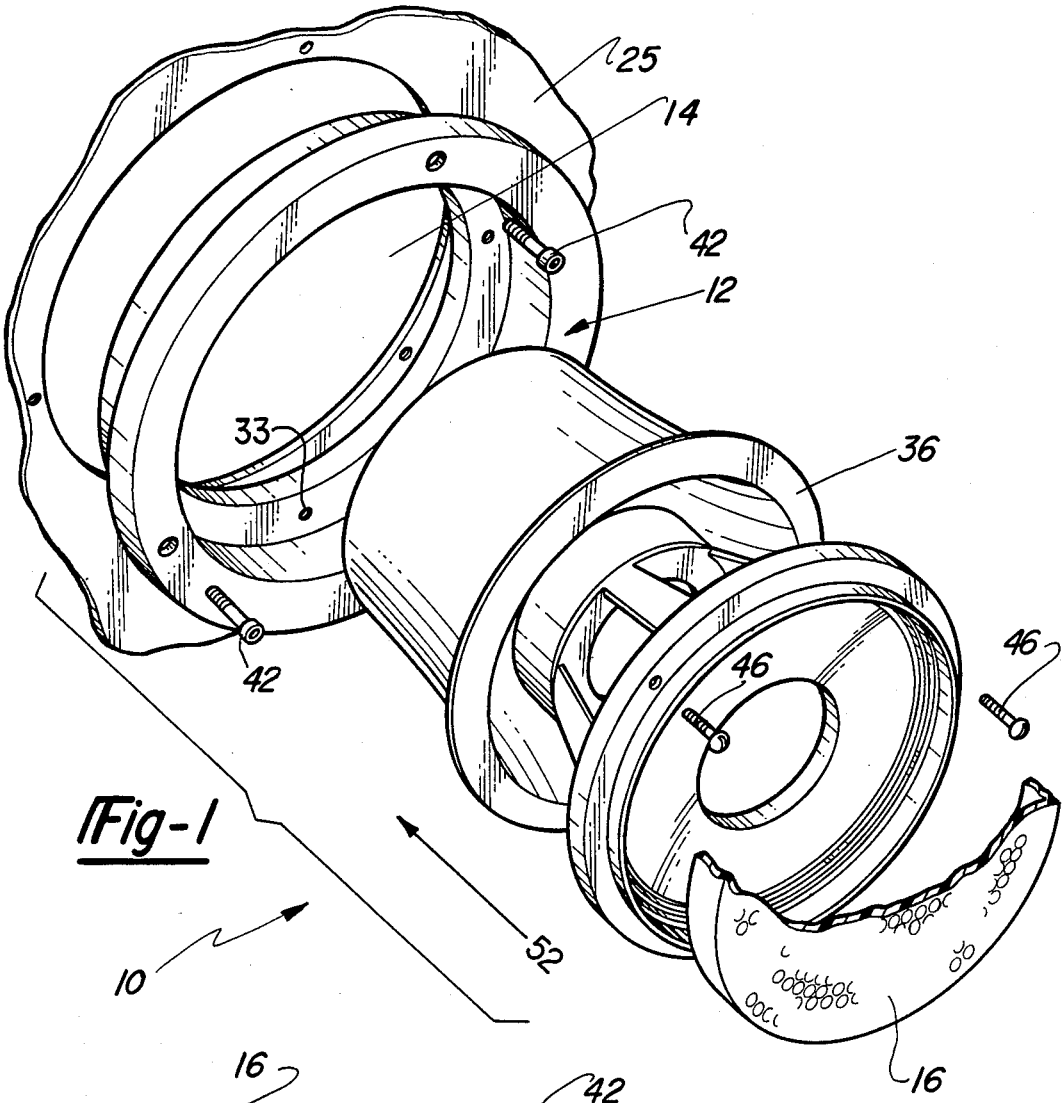
FIG. 1 is an assembly view of the speaker bracket system of the present invention.
Figure 2:
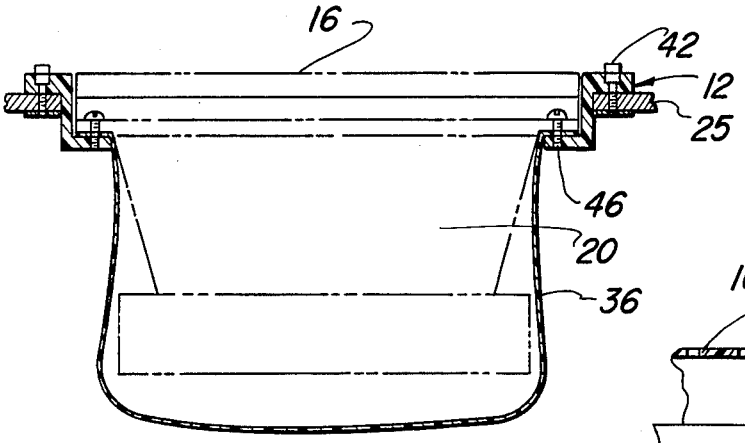
FIG. 2 is a section of the speaker bracket system taken along lines 2—2 of FIG. 1.
Figure 3:
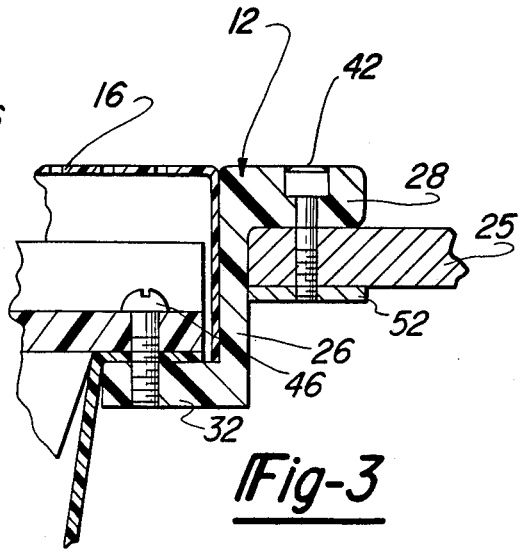
FIG. 3 is an exploded view of the mounting bracket depicted in FIG. 2.

Referring now to the drawings, there is depicted therein a speaker mounting system 10 in accordance with the present invention. Speaker mounting system 10 includes a mounting bracket 12 for an audio speaker 20. Bracket 12 has a cylindrical main body section 26, with a hollow center portion. Main body portion 26 may have a slight taper to enable a better coupling with a speaker grill 16. A mounting flange 28 extends outwardly in an essentially orthogonal direction from body section 26. Mounting flange 28 is used to secure bracket 12 to the surrounding environment, such as a vehicular door panel, or deck lid, in a manner to be subsequently described.

A mounting collar 32 extends inwardly in a direction that is essentially parallel to mounting flange 28. Mounting collar 32 is used to secure audio speaker 20 to bracket 12 as described below. Mounting bracket 12 is preferably ring-shaped or circular, but it may be rectangular, square, have rounded corners, or any other configuration. It is preferred that mounting bracket 12 be molded or otherwise formed into a unitary member.

Audio system 10 can be easily assembled by first attaching speaker 20 to mounting bracket 12 by means of a series of plurality of speaker mounting fasteners 46 mounted radially around collar 32, or by attaching bracket 12 to wall panel 25 as speaker 20 is inserted through hollow center 14 from a first or front direction 52, preferably from inside the passenger compartment (see FIG. 1), and then attaching speaker 20 to collar 32. Suitable openings 33 cicumferentially spaced about collar 32 permit fasteners 46, such as screws or the like, are projected therethrough. Bracket 12 and speaker 20 are then engaged to wall panel 25. A series of panel mounting fasteners 42 mount radially around flange 28 of bracket 12, in the same manner as with collar 32 to secure bracket 12 to panel 25. Collar fasteners 32 and flange fasteners 42 are also accessible from the first direction 52. Speaker grill 16 is precision fabricated so that it will mate into the hollow center portion 14 of bracket 12 by snag fitting or the like. An epoxy or other suitable adhesive may be applied between mounting bracket 12 and speaker grill 16 to secure grill 16 in place.

A backing plate 52 may be used for securely engaging panel mounting fasteners 42, which extend through the mounting flange 28 and wall panel 25. Backing plate 52, thus sandwiches wall panel 25 between flange 28 and plate 52 to securely mount assembly 10 to panel 25. As noted panel mounting fasteners 42 secure mounting flange 28 to wall panel 25, and speaker mounting fasteners 46 secure speaker 20 to collar 32.

The present invention further contemplates a waterproof member or backing membrane 36. Membrane 36 envelopes speaker 20 as shown. The terminus of membrane 36 is inserted between flange 32 and speaker 20, and is secured into position via fasteners 46. If speaker grill 16 is formed from a water impermeable material, the assembly is thereby sealed and rendered useful in environments where the unit may be exposed to water.

It is to be appreciated that the present invention provides a unitary system which can be easily mounted via flange 28 with or without backing plate 52 through fasteners. This enables the unit to be easily installed, repaired, or serviced.

While the invention has been described in conjunction with a specific embodiment, it is evident that many alternatives, modifications, and variations will be apparent to those skilled in the art in light of the disclosure herein. Therefore, it is intended that all such alternatives, modifications, and variations are included within the spirit and scope of the appended claims.

I claim:

1. A bracket for mounting an audio speaker to a wall panel of a vehicle, the wall panel having an opening, the speaker being insertable into and through the opening from a front direction, the bracket being attachable to the wall panel from the front direction, the bracket comprising:

a main body section, having a hollow center portion;

a collar being mountable to the speaker by fastening means, the collar having a shape, the fastening means being securable to the speaker from the front direction, the collar extending inwardly from the main body section, the collar being essentially normal to the plane of the main body portion; and a flange being mountable to the surface of the wall panel by securing means, the securing means being securable to the wall panel from the front direction, the flange extending outwardly in an essentially orthogonal direction from the main body section, enabling the bracket and the speaker to be inserted into the wall panel from the front direction, the flange having a shape which is generally the same as the shape of the collar.

2. The mounting bracket of claim 1, further comprising:

an engaging means that mates directly with a speaker cover.

3. The mounting bracket of claim 2, wherein the engaging means is part of the main body section that mates with the speaker cover.

4. The mounting bracket of claim 4, wherein the mounting bracket is a unitary member.

5. A bracket for mounting an audio speaker to a wall panel of a vehicle, the wall panel having an opening, the speaker being insertable into and through the opening from a first direction, the bracket being attachable to the wall panel from the first direction, the bracket comprising:

(a) a main body section, having a hollow center portion:

(b) a flange being mountable to the surface of the wall panel by securing means, the flange having a shape, the flange extending outwardly from the main body section, the securing means being securable into the wall panel from the first direction; and (c) a collar being mountable to the speaker by fastening means, the collar having a shape, the collar extending inwardly from the main body section, and the fastening means being fastenable into and through the collar and the speaker from the first direction.

6. The mounting bracket of claim 5, wherein the general shape of the flange is the same as the general shape of the collar.

7. The mounting bracket of claim 5, further comprising:

an engaging means that mates directly with a speaker cover.

8. The mounting bracket of claim 7, wherein the engaging means is part of the main body section that mates with the speaker cover.

9. The mounting bracket of claim 8, wherein the mounting bracket is a unitary member.

10. An audio system mounting assembly for mounting to the wall panel of a vehicle, the wall panel having an opening, the assembly comprising:

(a) an audio speaker, the speaker being insertable into and through the opening from a first direction;

(b) a bracket for mounting an audio speaker to a wall panel of a vehicle, the bracket having a main body section, a flange, and a collar, the main body section having a hollow center portion for insertion of the speaker therethrough, the flange having a shape, the flange extending outwardly from the main body section, the flange being mountable to the surface of the wall panel by securing means, the securing means being securable into the wall panel from the first direction, the collar being mountable to the speaker for fastening means, the collar having a shape, the collar extending inwardly from the main body section, and the fastening means being fastenable into and through the collar and the speaker from the first direction; and (c) a speaker cover that fits within the hollow center portion of the mounting bracket.

11. The assembly of claim 10, wherein the general shape of the flange is the same as the general shape of the collar.

12. The assembly of claim 10, further comprising:

a backing plate which is slightly larger than the body portion and is secured to the mounted flange and the panel.

13. The assembly of claim 10, further comprising:

a sealed material secured to the mounting collar and enveloping the speaker.

* * * * *